United States Patent [19]

Roberts et al.

[11] Patent Number: 4,886,945

[45] Date of Patent: Dec. 12, 1989

[54] REPLACEABLE BUSHING AND CONTACT ASSEMBLY FOR BLADE TYPE AIR INSULATED SWITCHGEAR

[75] Inventors: Gerald B. Roberts, Paris; Edward L. West, Centralia, both of Mo.

[73] Assignee: A. B. Chance Company, Centralia, Mo.

[21] Appl. No.: 106,379

[22] Filed: Oct. 6, 1987

[51] Int. Cl.[4] ..... H01H 33/02

[52] U.S. Cl. ..... 200/144 R; 200/148 R; 174/31 R; 174/151; 174/152 R

[58] Field of Search ..... 200/144 R, 148 B, 148 R; 174/31 R, 151, 152 R

[56] References Cited

U.S. PATENT DOCUMENTS

| | | | |
|---|---|---|---|
| 3,549,840 | 12/1970 | Harner . | |
| 3,576,967 | 5/1971 | Jeffries . | |
| 3,671,697 | 6/1972 | Harner et al. . | |
| 4,249,051 | 2/1981 | Votta | 200/148 B |
| 4,398,072 | 8/1983 | Harner et al. . | |

OTHER PUBLICATIONS

S&C Electric Company, Photo Sheet 785-800, "Manually Operated Styles", Aug. 3, 1981.

S&C Electric Company, Data Bulletin 785-80, "Selecting Standard Mounting Arrangement for Manually Operated Styles", Sep. 27, 1982.

*Primary Examiner*—Robert S. Macon

*Attorney, Agent, or Firm*—Hovey, Williams, Timmons & Collins

[57] ABSTRACT

Improved switchblade-type, air dielectric switchgear apparatus is provided which utilizes a minimum of supporting insulators and incorporates readily field-replaceable bushing assemblies so that the switchgear apparatus may be serviced in the field using only conventional tools. In preferred forms, the switchgear apparatus includes internal switch assemblies making use of substantially vertically oriented switchblades mounted for pivotal movement about an elevated, generally horizontal axis located above the corresponding stationary contacts. The replaceable bushing assemblies are advantageously mounted at a level for interconnection with the upper ends of associated switchblades, and the assemblies include a conical outermost connection and adapted to receive a line connecting elbow, together with an elongated, inwardly extending, electrically conductive intermediate portion carrying an innermost terminal. The inner terminal is designed for frictionally engaging the upper end of an associated switchblade, and for this purpose includes a pair of depending, spring-loaded contact plates. If a given bushing assembly requires replacement, it is only necessary to externally disconnect the assembly from the switch housing wall, followed by manual removal of the defective assembly. An identical replacement assembly is then inserted through the tank wall and the assembly terminal is initially positioned relative to the switchblade, this operation being facilitated by visual inspection through a window below the bushing assemblies. The replacement bushing is then attached using external connection hardware, this operation serving to properly and finally position the terminal relative to the switchblade.

17 Claims, 2 Drawing Sheets

REPLACEABLE BUSHING AND CONTACT ASSEMBLY FOR BLADE TYPE AIR INSULATED SWITCHGEAR

BACKGROUND OF THE INVENTION

1. Field of the Invention

The present invention is concerned with improved blade-type, air dielectric switchgear apparatus used by electrical utilities in their transmission and distribution systems. More particularly, it is concerned with such switchgear having a novel mounting arrangement for the switchblades therein, and with removable and field-replaceable bushing assemblies associated with the respective internal switch mechanisms of the gear.

2. Description of the Prior Art

Electrical utilities make use of a large number and variety of switchgear devices in their transmission and distribution systems. Such devices are used for sectonalizing purposes in order to isolate respective zones for component repair or the like and to provide desirable system coordination. System switchgear of this type may be of the pad-mounted variety and can include vacuum switches under oil or air dielectric switchgear.

Air dielectric switchgear are typically larger than the vacuum variety, and usually include internal switchblade arrangements, i.e., they are provided with a stationary contact and a movable contact, the latter being a part of an elongated, pivotally supported switchblade. Furthermore, such switchgear typically have appropriate source and load side bushings extending through opposed sidewalls of the switchgear housing. Conventional elbow-type line connectors are then secured to the respective bushings, as those skilled in the art will readily understand.

In the latter connection, it commonly occurs in the servicing and maintenance of switchgear that the bushings originally provided become damaged. In particular, and especially in the case of high amperage source side bushings, it is the common practice to install a connector elbow over the bushing and to insert a relatively long bolt through the elbow and into threaded engagement with the bushing structure. Inasmuch as attachment and detachment of such elbow may often occur under live conditions, use must be made of elongated hotline tools. As a consequence, it is relatively easy for a lineman to cross-thread or strip the threading of the bushing. This in turn necessitates that the bushing be replaced.

A prime drawback of many conventional switchgear devices is that bushing replacement cannot be readily completed in the field. Indeed, in certain types of gear, bushing replacement can be so formidable as to require that the apparatus be moved from service and taken to a repair shop. Obviously, this is an expensive and time-consuming operation.

In short, there is a real and unsatisfied need in the art for switchgear apparatus equipped with field-replaceable bushing assemblies which can be readily and easily changed by lineman in the field without special tools or an undue amount of labor.

SUMMARY OF THE INVENTION

The present invention overcomes the problems outlined above, and provides an improved switchgear apparatus provided with readily replaceable bushing assemblies which can be installed completely from the exterior of the switchgear housing using only conventional and readily accessible tools.

To this end, the switchgear of the invention is of the switchblade type, and makes use of a novel mounting arrangement for the internal switchblades, i.e., such blades are mounted within the housing in an upright orientation with the pivot axis for the blades being elevated and generally horizontal. Thus, the movable switch contacts are disposed below the pivot axis for the switchblades, and correspondingly the mating stationary contacts are located below the blades.

Orientation of the switchblades in a depending fashion as described minimizes the number of expensive skirted insulators used per phase switch, i.e., four such insulators as opposed to the five insulators commonly employed. Moreover, the switchblade location permits use of self-contained bushing assemblies preferably located at an elevated position proximal to the upper end of the associated switchblade. The bushing assembly includes an outboard end adapted to receive a line connector such as an elbow or the like, an elongated, electrically conductive intermediate portion, and an inboard terminal adjacent the inner end of the intermediate portion. The terminal includes structure for making a frictional fit, mechanical and electrical connection with a mating component within the switchgear housing, solely by manipulation of the bushing assembly from a point outside of the housing.

In particularly preferred forms, the internal terminal of the bushing assembly is designed to make a direct, frictional, mechanical and electrical connection with the upper end of the switchblade itself. For this purpose, the inner terminal comprises a pair of spring metal contacts adapted to receive therebetween the upper end of the associated switchblade.

In use when it is necessary to change a de-energized bushing, it is only necessary to loosen the external mounting structure therefor (normally in the form of a mounting ring and nuts threaded onto outwardly extending studs on the housing wall), whereupon the unitized bushing assembly can be manually removed from the housing by pulling the same through the entrance hole in the housing wall. At this point, a replacement bushing assembly is simply pushed through the entrance opening until the internal terminal is aligned with and engages the upper end of the corresponding switchblade. Such initial orientation of the inner terminal can be readily checked through the sidewall window normally provided with such switchgear. The external mounting hardware is then applied, and, as the nuts are tightened, the inner terminal is moved into its proper relationship relative to the upper end of the switchblade.

DESCRIPTION OF THE PREFERRED EMBODIMENT

Figure 1:
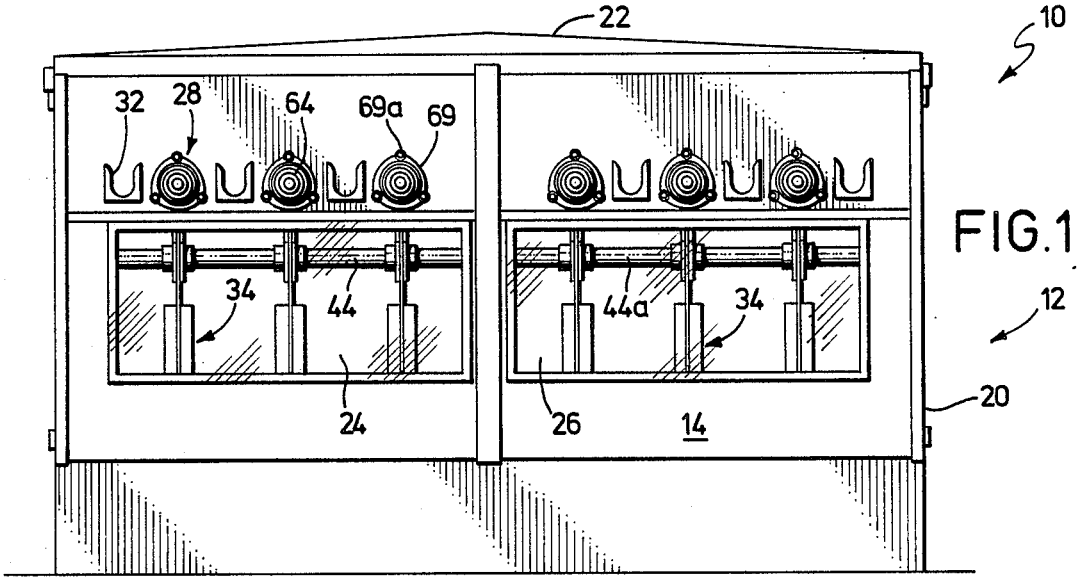
FIG. 1 is a side elevational view of the blade type, air dielectric switchgear of the invention, depicting the source side thereof with the window openings permitting viewing of the respective internal switchblades.
Figure 2:
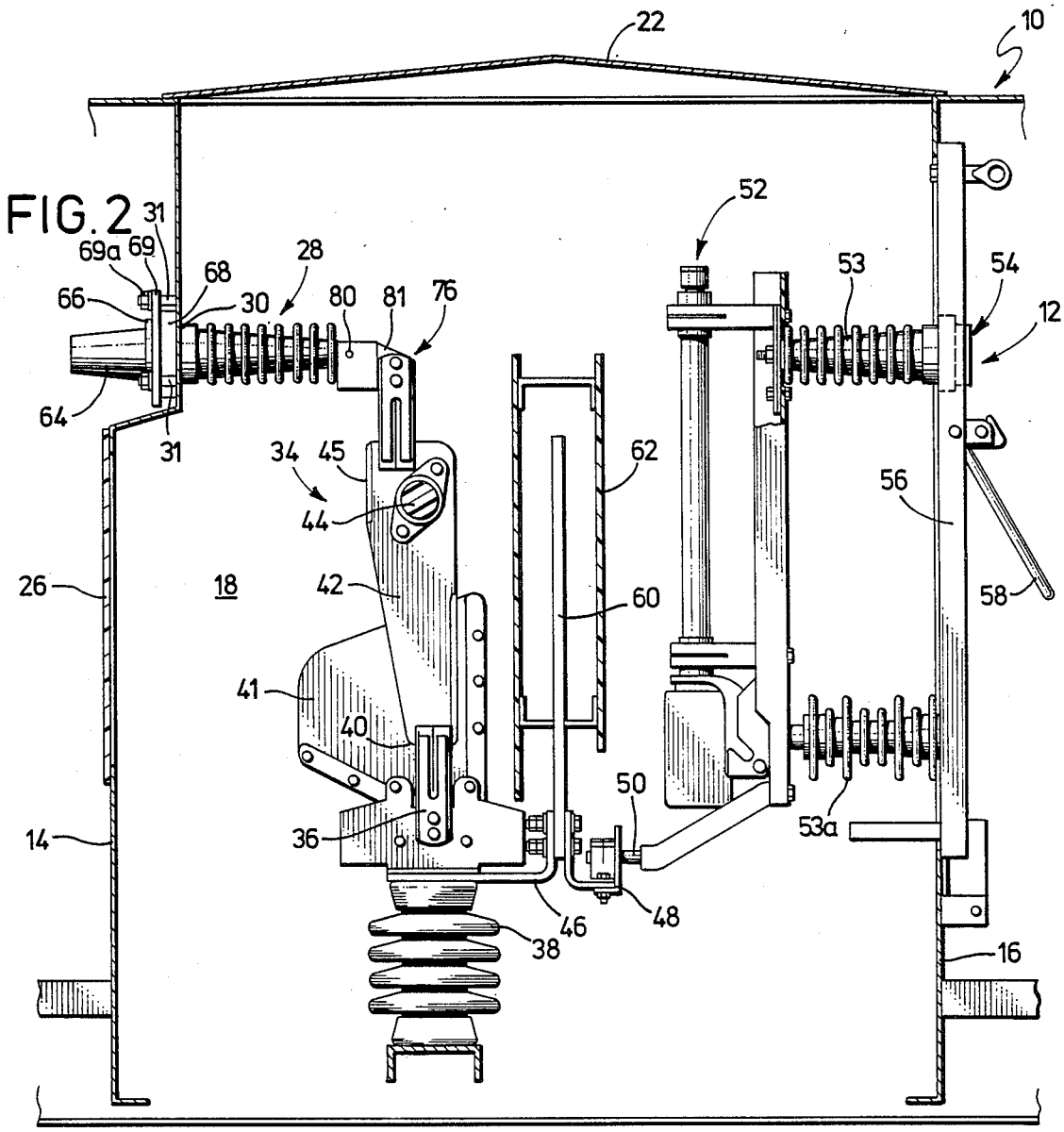
FIG. 2 is a vertical sectional view of the switchgear depicted in FIG. 1, illustrating in detail one of the internal switch assemblies.

Turning now to the drawing, improved switchgear 10 in accordance with the invention is illustrated in FIGS. 1 and 2. The switchgear 10 includes an upright housing 12 having a source side bushing wall 14, an opposed, spaced apart load side bushing wall 16, a pair of end walls 18, 20, and a gabled, moisture-shedding top wall 22.

The source side bushing wall 14 has a pair of laterally spaced apart transparent windows 24, 26 therein together with a total of six laterally spaced apart bushing assemblies above the windows 24, 26. Each bushing assembly 28 is inserted through an appropriately sized opening 30 in wall 14. Threaded mounting studs 31 are located around each opening 30 for attachment of the assemblies 28 as will be described. Each bushing assembly 28 is also provided with an external parking stand 32 designed to receive a terminal elbow during servicing of the switchgear.

The switchgear 10 as illustrated in the drawings is a three-phase device, and accordingly is provided with a total of three laterally spaced apart switch mechanisms 34 which are ganged as described hereinafter. FIG. 2 illustrates one of the switch mechanisms 34 in detail. Specifically, the illustrated mechanism 34 includes a stationary metallic contact 36 supported by an upstanding, skirted insulator 38. A movable contact 40 is also provided with the overall mechanism 34, and forms a part of an elongated, depending, conductive switchblade 42. A conventional arc chute device 41 is situated adjacent the lower contact 36 to suppress arcing during opening and closing of the switch mechanism. Switchblade 42 is in turn mounted for pivotal movement thereof on an elongated, transversely extending, insulative shaft 44. Moreover, it will be seen that the upper edge 45 of the blade 42 is beveled, and the importance of this feature will be explained hereinafter.

Insulator 38 also supports a somewhat L-shaped bracket 46. Conventional line terminal 48 is bolted to the bracket 46 as illustrated, and has a conductor 50 secured therein. The conductor 50 in turn leads through structure not pertinent to the present invention to a fuse assembly 52 (supported on spaced bushing 53 and insulator **53*a*) and, ultimately, to a load side bushing assembly 54 which extends through an appropriately sized opening in an upright panel 56. Panel 56 is rotatably supported within wall 16. An external operating bail 58 extends outwardly from the panel 56, to permit selective rotation of the panel and the associated fuse assembly 52** outwardly for servicing purposes.

The bracket 46 also services to permit connection of appropriate U-shaped buss bars 60 which extend between and electrically interconnect associated phase switch mechanisms 34 within the switchgear 10. As illustrated, the buss bars 60 are partially encased with an insulative inner housing 62.

The three switch mechanisms visible through window 24 (see FIG. 1) are mounted for simultaneous operation on the shaft 44. An operator independent, fast acting, spring loaded operating mechanism is affixed to wall 18 and an external operating handle (not shown) is provided adjacent wall 18 in order to effect selective opening and closing of the three ganged switch mechanisms. In like manner, the three switch mechanisms 34 visible through window 26 in FIG. 1 are mounted for simultaneous pivoting operation on a common shaft **44*a*; and a separate operating mechanism is provided adjacent wall 20** for this purpose. Further details of the preferred switch operating mechanism and of the overall switchgear apparatus, are to be found in simultaneously filed application Ser. No. 07/106,546entitled "Spring Actuated Latch, Load and Trip Mechanism for Switchgear" in the name of Gerald Roberts; this application is incorporated by reference herein.

The preferred bushing assemblies 28 used in switchgear 10 are in the form of self-contained units In particular, each of the assemblies 28 includes an outboard, conical, internally threaded connection end 64 adapted to receive a line connector such as a conventional elbow. A pair of radially enlarged abutment collars 66, 68 are formed at the base of connection end 64, with the collar 68 being sized to abut wall 14 in surrounding relationship to the opening 30. Each assembly 28 is maintained in position by means of an apertured retainer ring 69 which engages collar 68 and presses the same against wall 14; nuts **69*a* threaded onto the studs 31** are used to secure the entire assembly in place.

Figure 5:
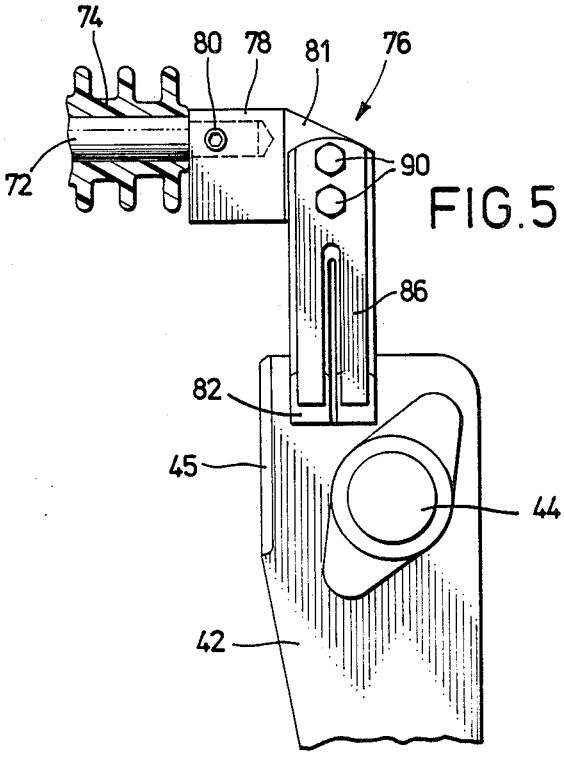
FIG. 5 is a fragmentary view in partial vertical section illustrating the replacement bushing correctly installed with respect to its associated switchblade.
Figure 6:
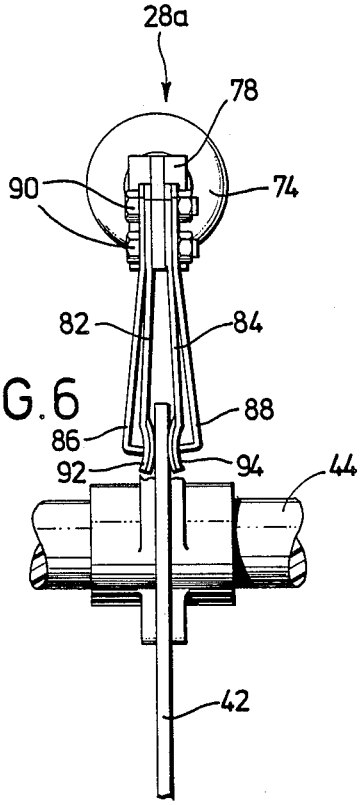
FIG. 6 is a fragmentary end view depicting the frictional fit mechanical and electrical connection between the inner terminal of the bushing assembly of the invention, and the upper end of a switchblade.

The assembly 28 further includes an elongated, electrically conductive, inwardly extending intermediate portion 70 having a central, metallic conductor 72 (see FIG. 5) together with a skirted, insulative outer jacket 74. The innermost end of the assembly 28 is in the form of a metallic terminal 76. The terminal 76 includes a connection block 78 adapted to receive the inner end of conductor 72, a set screw 80 being provided to assure a rigid connection between the conductor 72 and block 78. The terminal 76 further includes an inwardly projecting, apertured tang 81, and a pair of depending, metallic, contact plates 82, 84, together with outer, somewhat L-shaped, spring loaded retainers 86, 88. It will be observed in this respect that the described contact and retainer arrangement is secured to tang 81 by means of a pair of bolt and nut assemblies 90. As best seen in FIG. 6, the lowermost ends of the contacts 82, 84, are dimpled as at 92, 94, with the lower ends of the associated retainers 86, 88 engaging the dimpled regions.

The contact plates 82, 84 are designed to receive therebetween the upper end of a corresponding switchblade 42. By virtue of the dimpled regions 92, 94, and the spring retainers 86, 88, it will be appreciated that a firm frictional fit is provided between the terminal 76 and switchblade 42. Furthermore, this frictional fit is maintained during the entire operational sequence of the blade 42, i.e., when the blade is in its downwardly extending, contact closed position, or in its upwardly pivoted, contact open position.

To recapitulate, and as best seen in FIG. 2, during normal operation of switchgear 10, a current path is established through bushing assembly 28 and inner terminal 76, switchblade 42, stationary contact 36, bracket 46, terminal 48, conductor 50, fuse assembly 52 and load side bushing assembly 54.

If it becomes necessary to change a bushing assembly 28 in the field, the switchgear apparatus 10 is first de-energized. At this point, the mounting nuts 69*a* for the defective bushing assembly are removed from the studs 31, together with the retainer ring 69. This permits the lineman to manually grasp connection end 64 of the defective assembly 28, and to pull the same forwardly and downwardly until the frictional connection between terminal 76 and the upper end of switchblade 42 is broken. At this point, the entire assembly 28 can be bodily removed through the opening 30. This operation can of course be monitored by the lineman through the viewing window directly beneath the defective bushing assembly.

Figure 3:
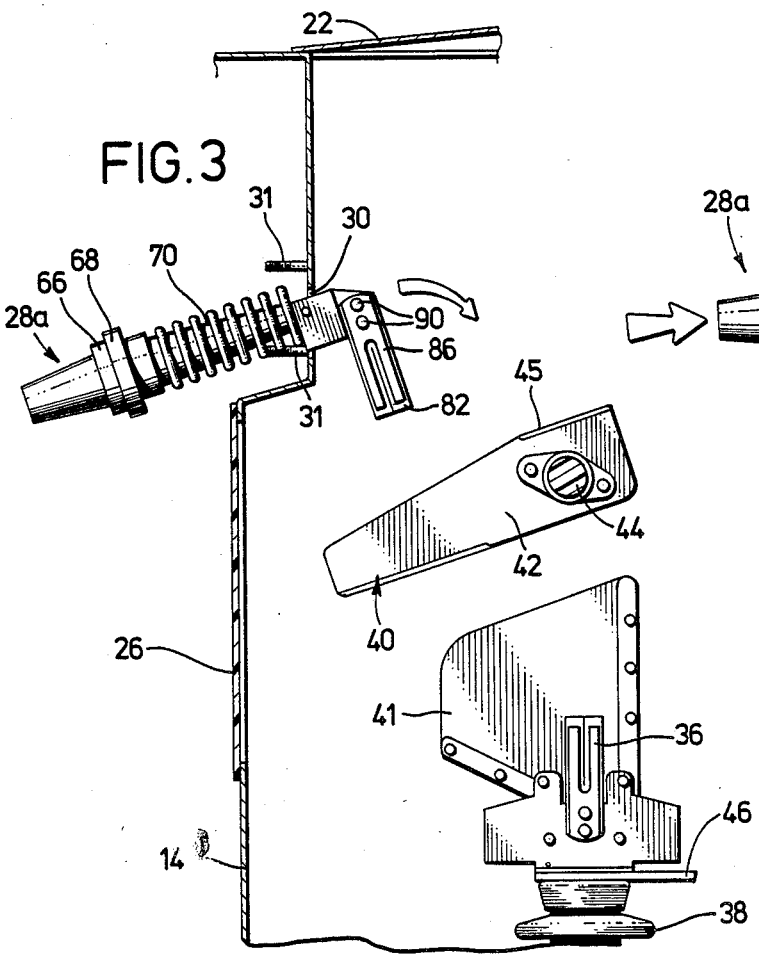
FIG. 3 is a fragmentary vertical sectional view illustrating the initial step in the replacement of a bushing assembly.
Figure 4:
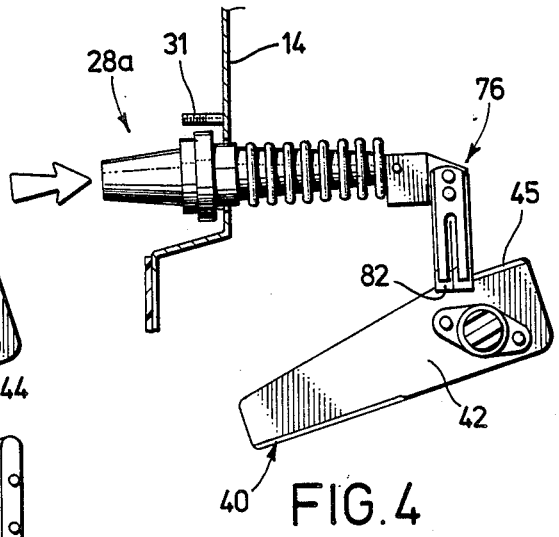
FIG. 4 is a fragmentary view similar to that of FIG. 3, but illustrating the replacement bushing assembly in preliminary engagement with the upper end of a corresponding switchblade.

FIGS. 3 and 4 illustrate the replacement operation using a new bushing assembly 28*a*. In particular, the assembly 28*a* is first inserted, terminal end first, through the opening 30 towards switchblade 42. Typically, this blade would be in an opened condition as illustrated in FIG. 3 with the beveled upper edge 45 of the blade being oriented to facilitate interconnection with the bushing assembly inner terminal.

In any event, as the bushing assembly 28*a* is pushed into and through the opening 30, the lineman monitors the position of the terminal 76 through the lower observation window. By this means, the lineman insures that the lower end of the terminal 76 comes into proper alignment with the beveled edge 45 of the switchblade 42, i.e., this beveled edge is between the dimpled lower ends of the contact plates 82, 84. By virtue of the fact that terminal 76 is made up of spring finger contact plates 82, 84 in conjunction with backup spring retainers 86, 88, the plates 82, 84 are resiliently deflectable to an extent such that the terminal is effectively self-centering and self-aligning when shifted toward and in engagement with blade contact 42. Thus, even though terminal 76 may not be exactly aligned with blade 42 during installation of the bushing assembly 28*a*, i.e., under circumstances such that the bushing assembly 28*a* is skewed or to one side of the centerline of the contact, the terminal 76 will slide over the blade 42 and move into properly aligned disposition.

When the terminal 76 is properly situated as viewed in FIG. 4, it is only necessary to reapply the retainer ring 69 and mounting nuts 69*a* to the threaded studs 31, this operation insuring that the entire bushing assembly 28 is moved into proper position relative to switchblade 42. Thereupon, the switchblade can be moved to its lower, contact closed position using the operating mechanism forming a part of the overall switchgear, whereupon the installation is complete. The final orientation of the replacement assembly 28*a* and the switchblade 42 is depicted in FIG. 6.

It is noteworthy in this respect that the above described bushing replacement operation can be readily performed in the field by an ordinary lineman. Indeed, it is believed that this operation can be completed in as little as ten minutes. This is to be contrasted with prior switchgear devices wherein bushing replacement has been relatively complex and time-consuming undertaking.

We claim:

1. In electrical switchgear apparatus including a housing having walls, source and load side bushings extending through said housing walls, and blade-type switch means within said housing and electrically coupled between said source and load side bushings for selectively making or breaking a current path through the switchgear, said switch means having an elongated, pivotal blade with a movable electrical contact adjacent one end thereof and pivotal mounting structure adjacent the other end thereof, and a stationary contact adapted for mating engagement with said movable contact, the improvement which comprises:

means mounting said switchblade in an upright orientation with said movable contact disposed below said pivotal mounting structure for pivotal movement of the switchblade about an elevated, generally horizontal pivot axis; and means supporting said stationary contact for engagement with said movable contact in a location below said pivot axis, there being a bushing assembly electrically coupled with said switchblade and physically located at an elevated position proximal to the upper end of the switchblade, said bushing assembly being a self-contained unit having an outboard end adapted to receive a line connector, an elongated, electrically conductive intermediate portion, and an inboard terminal adjacent the end of said portion remote from said outboard end, said terminal including structure for making a frictional fit mechanical and electrical connection with a mating component of the switchblade within said housing by manipulation of the assembly from a point outside said housing.

2. The switchgear apparatus of claim 1, said frictional fit connection structure comprising a pair of separable, spring-loaded metal contacts.

3. The switchgear apparatus of claim 1, said mating component being the upper end of said switchblade, said frictional fit connection structure being configured for direct engagement with said upper end of said switchblade.

4. The switchgear apparatus of claim 1, the upper end of said switchblade being beveled to facilitate interengagement between said frictional fit connection structure and the switchblade.

5. The switchgear apparatus of claim 1, including threaded connector means for releasably securing said bushing assembly to a wall of said housing.

6. The switchgear apparatus of claim 1, said bushing assembly being a source side bushing assembly.

7. The switchgear apparatus of claim 1, said intermediate portion comprising a central conductor extending between said outboard end and terminal, and insulator means surrounding said conductor.

8. In electrical switchgear apparatus including a housing having walls, source and load side bushings extending through said housing walls, and blade-type switch means within said housing and electrically coupled between said source and load side bushings for selectively making or breaking a current path through the switchgear, said switch means having an elongated, pivotal blade with a movable electrical contact adjacent one end thereof and pivotal mounting structure adjacent the other end thereof, and a stationary contact adapted for mating engagement with said movable contact, the improvement which comprises:

a self-contained bushing assembly electrically coupled with said switchblade and having an outboard end adapted to receive a line connector, an elongated, electrically conductive intermediate portion, and an inboard terminal adjacent the end of said portion remote from said outboard end, said terminal including structure for making a frictional fit mechanical and electrical connection with a mating component within said housing by manipulation of the assembly from a point outside said housing.

9. The switchgear apparatus of claim 8, said bushing assembly being located at a height proximal to the height of said switchblade pivotal mounting structure.

10. The switchgear apparatus of claim 8, said frictional fit connection structure comprising a pair of separable, spring-loaded metal contacts.

11. The switchgear apparatus of claim 8, said mating component being the end of said switchblade adjacent said pivotal mounting structure, said frictional fit connection structure being configured for direct engagement with said mating component end of said switchblade.

12. The switchgear apparatus of claim 11, said mating component end of said switchblade being beveled to facilitate interengagement between said frictional fit connection structure and said switchblade.

13. The switchgear apparatus of claim 8, including threaded connector means for releasably securing said bushing assembly to a wall of said housing.

14. The switchgear apparatus of claim 8, said bushing assembly being a source side bushing assembly.

15. The switchgear apparatus of claim 8, said intermediate portion comprising a central conductor extending between said outboard end and terminal, and insulator means surrounding said conductor.

16. A self-contained field-replaceable bushing assembly for use with housing-encased switchgear apparatus, said bushing assembly comprising:

an outboard end adapted to receive a line connector;

an elongated, electrically conductive intermediate portion operably coupled with said outboard end; and an inboard terminal adjacent the end of said portion remote from said outboard end and operably connected to the portion, said inboard terminal including structure for making a frictional fit mechanical and electrical connection with a mating component within said switchgear apparatus by manipulation of the assembly from a point outside the housing, said frictional fit connection structure comprising a pair of separable, spring-loaded metal contacts.

17. A self-contained field-replaceable bushing assembly for use with housing-encased switchgear apparatus, said bushing assembly comprising:

an outboard end adapted to receive a line connector;

an elongated, electrically conductive intermediate portion operably coupled with said outboard end; and an inboard terminal adjacent the end of said portion remote from said outboard end and operably connected to the portion, said inboard terminal including structure for making a frictional fit mechanical and electrical connection with a mating component within said switchgear apparatus by manipulation of the assembly from a point outside the housing, said frictional fit connection structure being configured for direct engagement with a pivotal switchblade.

* * * * *